United States Patent [19]

Ogura et al.

[11] Patent Number: 4,466,326

[45] Date of Patent: Aug. 21, 1984

[54] ELECTRONIC MUSICAL INSTRUMENT

[75] Inventors: Takeshi Ogura; Kimimaro Tamura; Yoshikazu Okuma, all of Osaka, Japan

[73] Assignee: Matsushita Electric Industrial Co., Ltd., Osaka, Japan

[21] Appl. No.: 483,202

[22] Filed: Apr. 8, 1983

Related U.S. Application Data

[63] Continuation of Ser. No. 258,303, Apr. 28, 1981, abandoned.

[30] Foreign Application Priority Data

| | | | |
|---|---|---|---|
| Apr. 30, 1980 | [JP] | Japan | 55-57352 |
| Apr. 30, 1980 | [JP] | Japan | 55-57368 |
| Apr. 30, 1980 | [JP] | Japan | 55-57377 |

[51] Int. Cl.[3] ..... G10H 1/08; G10H 1/36

[52] U.S. Cl. ..... 84/1.22; 84/DIG. 23

[58] Field of Search ..... 84/1.01, 1.03, 1.11–1.13, 84/1.17, 1.19–1.24, DIG. 7, DIG. 22, DIG. 23; 340/365 S; 364/707; 371/4, 5

[56] References Cited

U.S. PATENT DOCUMENTS

| | | | |
|---|---|---|---|
| 4,148,241 | 4/1979 | Morez et al. | 84/1.03 |
| 4,205,576 | 6/1980 | Deutsch et al. | 84/1.17 |
| 4,294,155 | 10/1981 | Turner | 84/1.01 |
| 4,357,851 | 11/1982 | Markowitz et al. | 84/1.01 |

*Primary Examiner*—Stanley J. Witkowski

*Attorney, Agent, or Firm*—Burgess, Ryan & Wayne

[57] ABSTRACT

An electronic musical instrument comprises a keyboard device on which a player plays melodies or accompaniments, a sound pitch information or data processing means for producing a sound pitch information or data specified by the operation of the keyboard device and a sound pitch information or data which is above or below the specified sound pitch information or data by a predetermined number of semitones, a sound source responsive to the sound pitch information or data from the sound pitch information or data processing means for generating the corresponding musical sound signals, and an electro-acoustic transducer means for converting the musical sound signals derived from the sound source into the corresponding acoustic signals. The clock frequency of the data processing means can be switched to a lower clock frequency during a data readout or write-in time interval and a short time interval immediately following it.

9 Claims, 19 Drawing Figures

FIG. 5

| NOTE OR TONE | KEY CODE | | KEY CODE AUGMENTED BY A PERFECT FIFTH | |
|---|---|---|---|---|
| | OCTAVE | NOTE | OCTAVE | NOTE |
| B2 | 2 | B | 3 | 6 |
| A2# | 2 | A | 3 | 5 |
| A2 | 2 | 9 | 3 | 4 |
| G2# | 2 | 8 | 3 | 3 |
| G2 | 2 | 7 | 3 | 2 |
| F2# | 2 | 6 | 3 | 1 |
| F2 | 2 | 5 | 3 | 0 |
| E2 | 2 | 4 | 2 | B |
| D2# | 2 | 3 | 2 | A |
| D2 | 2 | 2 | 2 | 9 |
| C2# | 2 | 1 | 2 | 8 |
| C2 | 2 | 0 | 2 | 7 |
| B1 | 1 | B | 2 | 6 |
| A1# | 1 | A | 2 | 5 |
| A1 | 1 | 9 | 2 | 4 |
| G1# | 1 | 8 | 2 | 3 |
| G1 | 1 | 7 | 2 | 2 |
| F1# | 1 | 6 | 2 | 1 |
| F1 | 1 | 5 | 2 | 0 |
| E1 | 1 | 4 | 1 | B |
| D1# | 1 | 3 | 1 | A |
| D1 | 1 | 2 | 1 | 9 |
| C1# | 1 | 1 | 1 | 8 |
| C1 | 1 | 0 | 1 | 7 |

ELECTRONIC MUSICAL INSTRUMENT

This application is a continuation, of application Ser. No. 258,303, filed Apr. 28, 1981, and now abandoned.

BACKGROUND OF THE INVENTION

The present invention relates to an electronic musical instrument of the type in which when a player depresses a key of the keyboard so as to produce a tone, a tone above or below the selected tone by, for example, a perfect fifth is also automatically produced and mixed with the selected tone, whereby the player can play from solemn musics to gimmick musics.

When a player plays an electronic musical instrument , he or she simultaneously depresses two keys spaced apart by one octave so that various sounds can be produced. However, it is very difficult for a player to play a music at a fast speed with a single hand and it is next to impossible to simultaneously depress the keys spaced apart by two octaves by a single hand. As a result, the player must accept poor and unsatisfactory musical tones even though more solemn and wide tones are desired.

In the conventional electronic musical instrument, a data processing means or unit receives or transmits input or output data over long transmission lines because of the shape of the musical instrument. In addition, the electronic musical instrument must process a very large amount of data within a very short time interval in order to produce various sounds. In order to shorten the data processing time, the clock frequency of the data processing unit must be increased as high as possible. However, the increase in clock frequency frequently results in erratic operations. When the clock frequency is lowered in order to avoid erratic operations, the data processing time is increased so that the electronic musical instrument cannot perform its functions satisfactorily.

SUMMARY OF THE INVENTION

In view of the above, one of the objects of the present invention is to provide an electronic musical instrument which can substantially eliminate the above and other drawbacks encountered in the conventional electronic musical instrument.

Another object of the present invention is to provide an electronic musical instrument which can produce various kinds of tones by simple operations.

A further object of the present invention is to provide an electronic musical instrument in which the clock frequency of a data processing unit is switched to a lower clock frequency at least during a data read-out or write-in time interval so that erratic operations can be avoided and the data processing time can be shortened, whereby highly reliable operation can be ensured.

To the above and other objects, briefly stated, the present invention provides an electronic musical instrument characterized by the provision of a keyboard device upon which one plays melodies or accompaniments, a sound pitch information or data processing means for producing a first information or data representative of a tone or note selected or specified by the depression of a key of the keyboard (to be referred to as the "first sound pitch information or data" in this specification) and a second information or data representative of a tone or note above or below the first sound pitch information or data by a predetermined number of semitones (to be referred to as the "second sound pitch information or data" in this specification), a sound source for producing musical sound signals corresponding the first and second sound pitch information or data received from the sound pitch information or data processing means, and an electro-acoustic transducer means for converting the sound signals into the corresponding acoustic signals.

The present invention further provides an electronic musical instrument characterized by the provision of a keyboard device on which one plays melodies or accompaniments, a timbre or tone quality selection means, a data processing means for controlling the states of the keyboard device and the timbre or tone quality selection means and producing the output data corresponding to the states thereof, a clock frequency switching means for switching the clock frequency of the data processing means to a lower clock frequency at least during a data read-out or write-in time interval a sound source for producing the musical sound signal corresponding to the depressed key in response to the musical sound generation data derived from the data processing means, and an electroacoustic transducer means for converting the musical sound signals into the corresponding acoustic signals.

The above and other objects, effects and features of the present invention will become more apparent from the following description of preferred embodiments thereof taken in conjunction with the accompanying drawings.

BRIEF DESCRIPTION OF THE DRAWINGS

FIG. 5 is a table showing notes or tones and their associated key codes;

The same reference numerals are used to designate similar parts throughout the figures.

DESCRIPTION OF THE PREFERRED EMBODIMENTS

Figure 1:
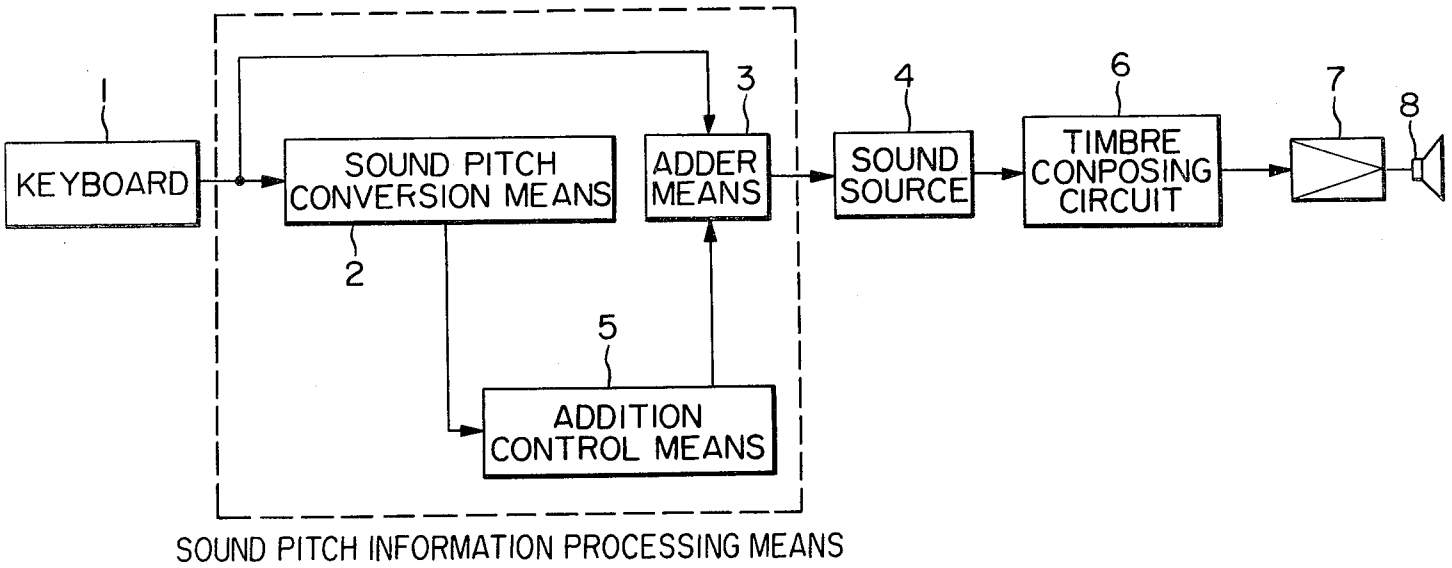
FIG. 1 is a block diagram of a first embodiment of an electronic musical instrument in accordance with the present invention.

In FIG. 1 is shown schematically a preferred embodiment of the present invention which has a keyboard 1, a sound pitch conversion means 2, an adder 3, a sound source 4, an addition control means 5, a timbre composing circuit 6, an amplifier 7 and a speaker 8. The sound pitch conversion means 2, the adder means 3 and the addition control means constitute a sound pitch information or data processing means.

A sound pitch information entered by depressing a key of the keyboard 1 is directly delivered to the adder means 3 while being converted by the sound pitch conversion means 2 into a predetermined sound pitch signal and delivered to the addition control means 5. The addition control means 5 makes the decision whether or not the sound pitch signal from the sound pitch conversion means 2 is delivered to the adder means 3. The adder means 3 receives the sound pitch information from the keyboard 1 and the sound pitch signal and delivers their logic sum to the sound source 4 which in turn generates the musical sound.

Figure 2:
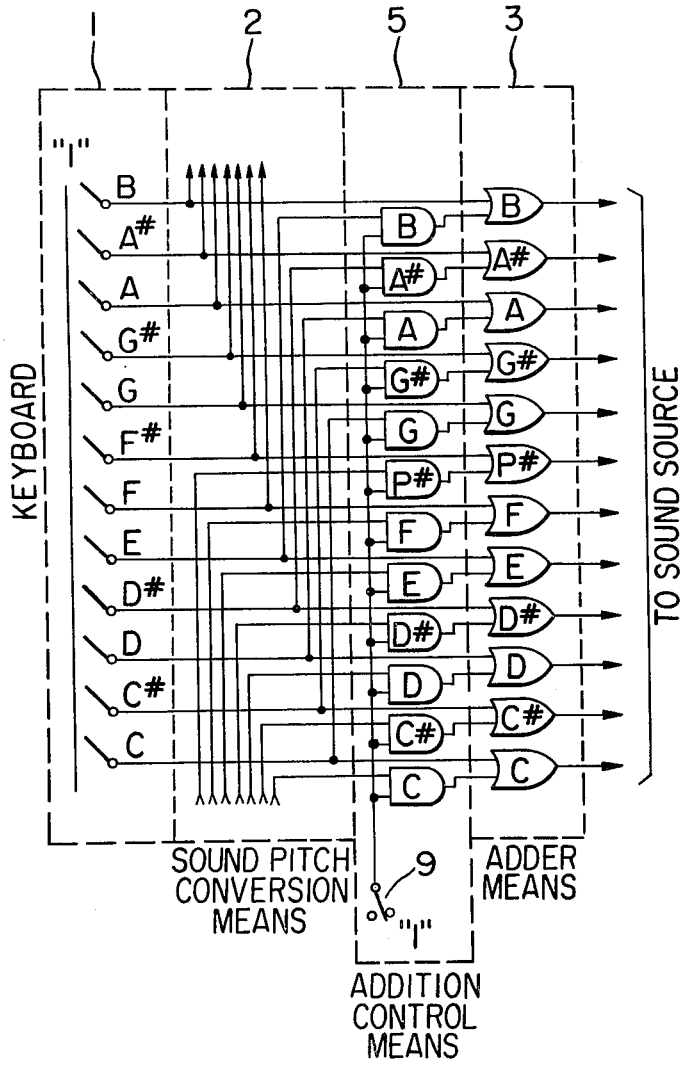
FIG. 2 is a circuit diagram of a keyboard and a sound pitch information or data processing means shown in FIG. 1.

The keyboard 1 and the sound pitch information processing means are shown in detail in FIG. 2. A perfect-fifth addition switch 9 can be manually or automatically operated in response to a control means not shown. For instance, when the key of C is depressed, a signal "1" is applied to an OR gate C in the adder means 3 which in turn delivers the signal "1" to the sound source 4 so that the musical sound of C is generated. Simultaneously, the signal "1" is also delivered to one input terminal of an AND gate G in the addition control means 5. When the perfect-fifth addition switch 9 is turned on as shown in FIG. 2, a signal "1" is also delivered to the other input terminal of the AND gate G so that the gate G delivers the signal "1" to an OR gate G in the adder means 3. The OR gate G in turn delivers the signal "1" to the sound source 4 so that the musical sound of G is generated.

As described above, when the key of C is depressed the musical sound of C and G are generated at the same time. Same is true for other keys. That is, when one key is depressed, not only the musical sound associated with the depressed key but also the musical sound spaced apart by a perfect fifth from the former are generated.

When the connections are changed in the circuit shown in FIG. 2, any other musical sounds separated by any suitable step or semitones can be added together.

Figures 3, 3B:
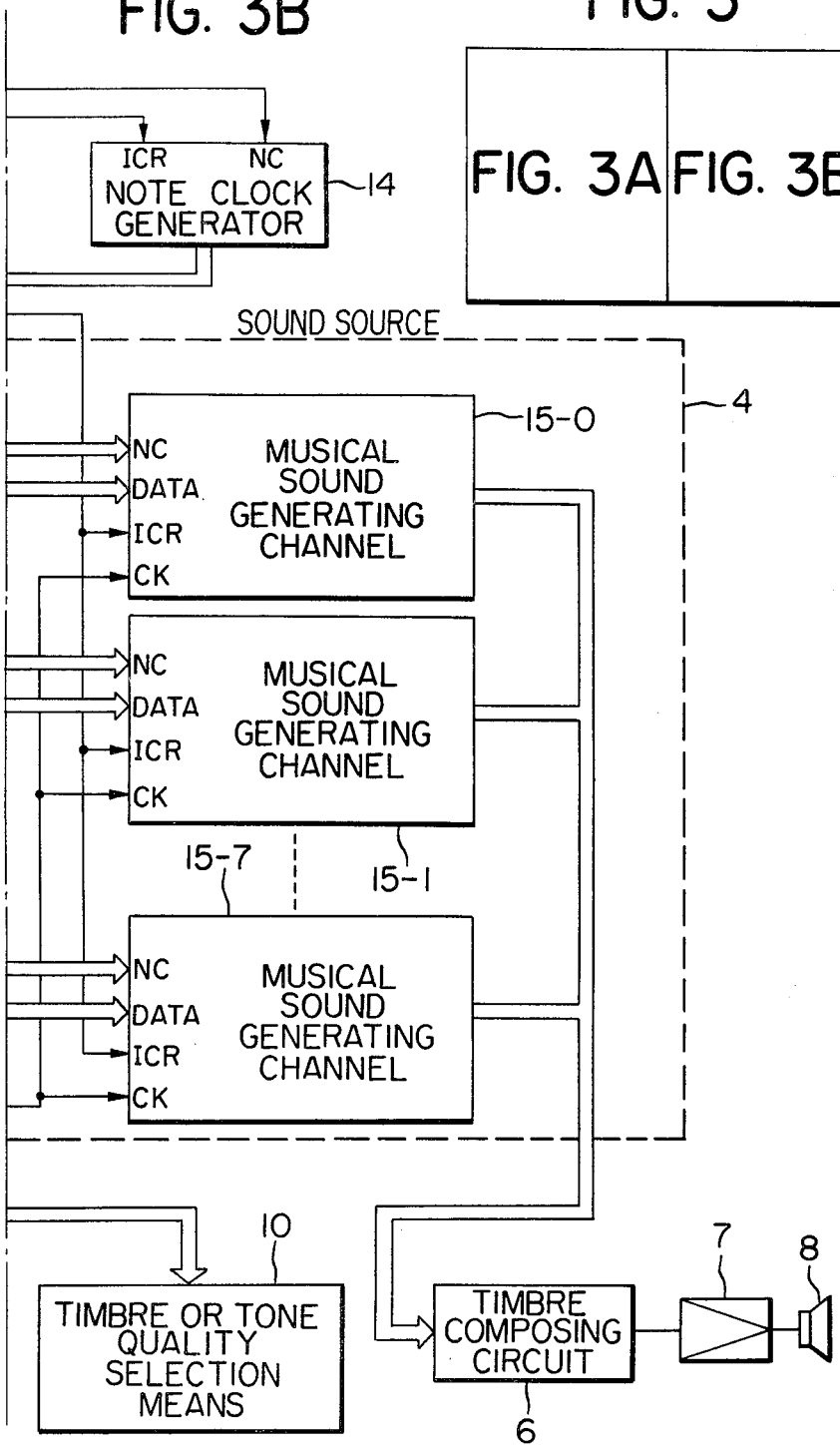
FIGS. 3A and 3B constitute a block diagram of a generator-assignment type electronic musical instrument to which is applied the present invention.
Figure 3A:
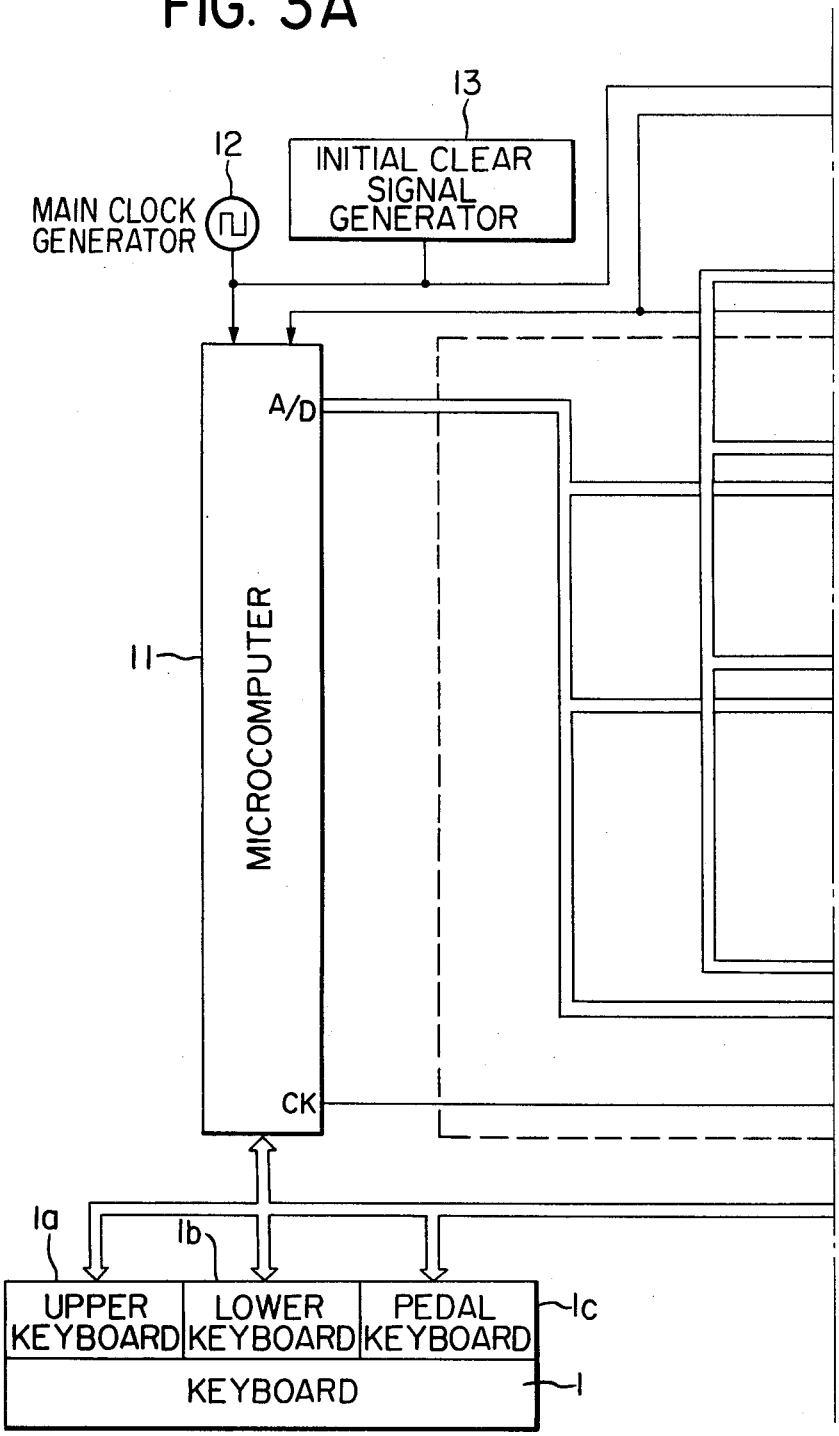

FIGS. 3, 3A and 3B show a generator-assignment type electronic musical instrument to which is applied the present invention. The keyboard 1 has an upper keyboard 1*a*, a lower keyboard 1*b* and a pedal keyboard 1*c*. A timbre or tone quality selection means 10 is operated by a tablet or the like so as to select a desired timbre. A microcomputer 11 detects which key is depressed and which timbre is selected. In response to the depression of a key, the microcomputer 11 assigns a vacant one of a plurality of musical sound generating channels and delivers, in a time division manner, a musical sound generation data (that is, the data representative of whether a key is turned on or off and a sound pitch; that is, a note data and an octave data) to the sound source 4 from the output terminal A/D. A channel clock signal for controlling writing and reading of the musical sound generation data is delivered from the output terminal CK of the microcomputer 11. An initial clear signal generator 13 generates an initializing signal when an on-off switch is turned on or when no musical sound is generated for a predetermined time interval. A note clock generator 14 receives the output signal from a main clock generator 12 and generates the tone signals corresponding to 12 semitones in the highest octave. The sound source 4 has a plurality (eight in this embodiment) of musical sound generating channels 15-0 through 15-7 the number of which is by far smaller than that of the keys of the keyboard 1. The output signals from the musical sound generating channels 15-1 through 15-7 are added to each other and the added signal is applied to the speaker 8 through the timbre composing circuit 6 and the amplifier 7 so as to be converted into an acoustic musical sound.

Referring still FIG. 3, the mode of operation will be described in more detail below. Assume that three keys of $C_1$, $E_1$ and $G_1$ are depressed and the string tone is selected by the timbre or tone quality selection means 10. Then the musical sound generation data for the tones $C_1$, $E_1$ and $G_1$ and the string tone data are delivered from the output terminal A/D of the microcomputer 11 to vacant musical sound generating channels. That is, the musical sound generation data for $C_1$ is delivered to the channel 15-0; the data for $E_1$, to the channel 15-1; and the data for $G_1$, to the channel 15-2. The string tone data is delivered to the channels 15-0 through 15-2. The sound generating channels 15-0 through 15-7 receive the top-octave note signal from the note clock generator 14 and the musical sound generating channels 15-0 through 15-2 read in the musical sound generation data and the string tone data in synchronism with the clock signals from the microcomputer 11 and select the note signals from the note clock generator 14 which correspond to the note data in the musical sound generation data. The selected note signals are frequency divided in response to the octave data and imparted with the string tone based on the tone data, whereby the selected musical sound signals $C_1$, $E_1$ and $G_1$ are generated. These signals are added together and applied through the timbre composing circuit 6 and the amplifier 7 to the speaker 8 so that the selected musical sounds are generated.

Same is true for other keys. That is, the musical sounds of selected notes and tone are generated.

If the note clock generator 14 is so designed and arranged that the note clock signals corresponding to the whole notes on the keyboard 1 are generated, the musical sound generation data delivered from the microcomputer 11 may include only the data representing whether a key is depressed or not and the data for a selected tone.

Figure 4:
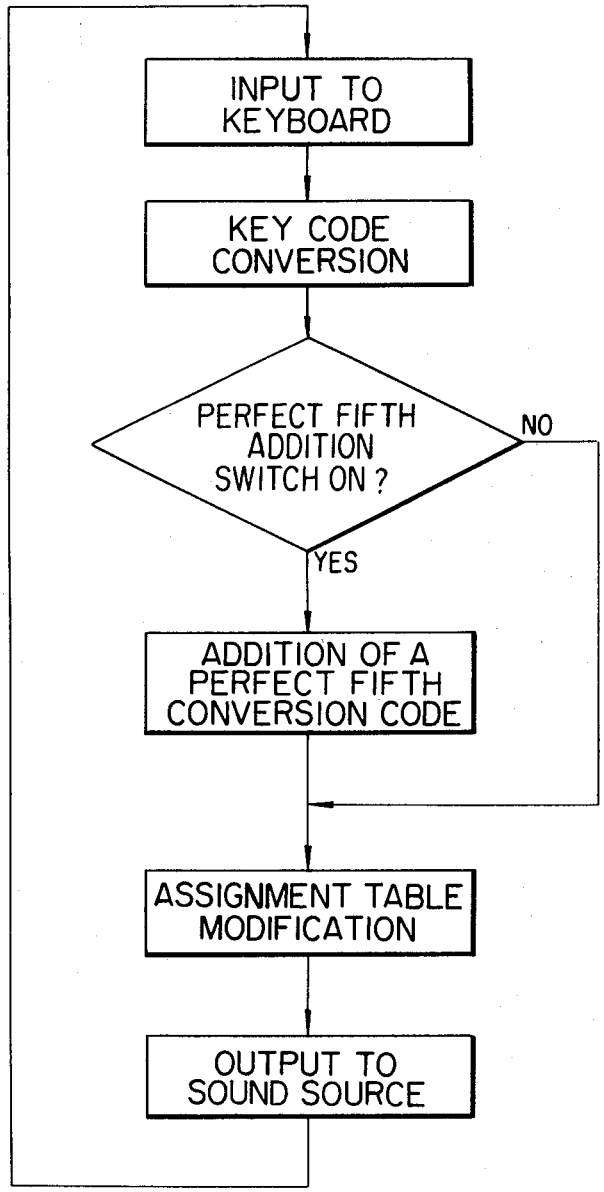
FIG. 4 is a flowchart of a program used in the musical instrument shown in FIG. 3.

A program as shown in FIG. 4 is stored in the microcomputer 11 in the electronic musical instrument of the type described above. Then, a musical sound selected by depressing a key on the keyboard and a musical sound spaced apart from the former by a perfect fifth. The mode of operation will be described in detail with reference to FIGS. 4 and 5. When the key of a selected note is depressed, a key code as shown in FIG. 5 is generated. When the perfect-fifth addition switch is turned on, the code "7" which corresponds to a perfect fifth is added. As a result, when the duodecimal addition results a carry, a tone or note augmented by a perfect fifth is in the next high octave.

For instance, assume that three keys $C_1$, $E_1$ and $G_1$ are depressed. Then, the keys of the keyboard 1 are sequentially scanned from the highest to the lowest key. Each time when one key is scanned, a note information or data register is decremented by one as shown in FIG. 5 and each time when the keys in one octave are scanned, an octave register is decremented by one. Therefore, when the keys of $C_1$, $E_1$ and $G_1$ are depressed, their octave and note data are converted into the codes "10", "14" and "17" which in turn are stored in a predetermined area in the microcomputer 11 which is referred to as "the depressed key register file" in this specification.

Now it is assumed that the perfect-fifth addition switch is turned on. The addition of a perfect fifth means to add "7" to a note data. Therefore, "7" is added to the key codes "10" for $C_1$, "14" for $E_1$ and "17" for $G_1$ so that "17" for $G_1$, "1B" for $B_1$ and "22" for $D_2$ are stored in the register file in the microcomputer. The addition of "7" to "17" results "22" because the duodecimal system is used as shown in FIG. 5. As a result, "17" for $G_1$, "1B" for $B_1$ and "22" for $D_2$ are stored in addition to "10" for $C_1$, "14" for $E_1$ and "17" for $G_1$, as if the keys of $G_1$, $B_1$ and $D_2$ were depressed. Next an assignment table is modified or revised so that these codes are delivered as the new data to the sound source 4.

As described above, according to the present invention, not only the musical sounds selected by the depression of the corresponding keys but also the musical sounds spaced apart from the former by predetermined semitones can be generated at the same time. Therefore, when the player is playing in 16, 4 and 2⅔ feet the musical sounds a perfect fifth below them, that is, sounds in 10⅔, 2⅔ and 1 7/9 feet are also generated so that the total of six footages are generated. As a result, a variety of consonance; that is, from solemn to gimmick musical sounds can be generated. In addition, the player can play with only one hand so that a music at a high tempo can be played solemnly.

In the electronic musical instrument of the type shown in FIG. 3, the upper, lower and pedal keyboards 1*a*, 1*b* and 1*c* on the one hand and the timbre or tone quality selection means 10 on the other hand are disposed at predetermined positions and are separated from each other by a relatively long distance. The sound source 4 which generates the acoustic musical sounds is disposed at a predetermined position spaced apart from them. Assume that the upper and lower keyboards 1*a* and 1*b* have 61 keys, respectively; the pedal keyboards 1*c* have 25 keys; and the timbre or tone quality selection means 10 have 60 electronic switches. Then, even when a logic sum connection among input and scanning signal lines is formed by the use of a matrix circuit, the upper and lower keyboards 1*a* and 1*b*, the pedal keyboard 1*c* and the timbre or tone quality selection means 10 must be interconnected with each other with the following numbers of signal lines totaling to 60 lines.

| | Input signal lines | Output signal lines |
|---|---|---|
| upper keyboard | 8 | 8 |
| lower keyboard | 8 | 8 |
| pedal keyboard | 4 | 8 |
| timbre or tone quality selection means | 8 | 8 |

Figure 6:
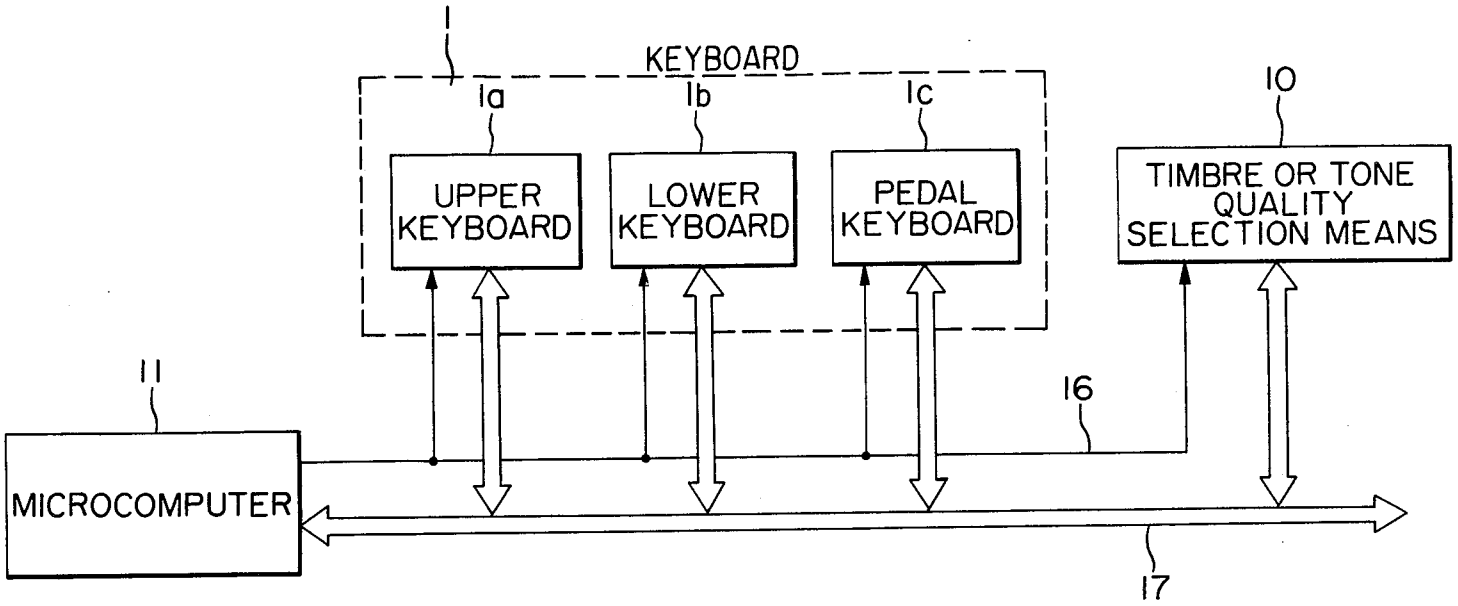
FIG. 6 is a block diagram of another embodiment of the present invention.

According to the present invention, however, the number of input and output signal lines can be reduced as will be described below with reference to FIG. 6. The microcomputer 11, the three keyboards 1*a* through 1*c* and the timbre or tone quality selection means 10 are interconnected with a strobe line 16 and a data bus 17. A coded address data for discriminating an input is transmitted over the data bus 17 from the microcomputer 11 to the keyboards 1*a* through 1*c* and to the timbre or tone quality selection means 10. In response to the address data, a selected musical sound generation data and a tone data are delivered to the microcomputer in the time division manner. The address data and the input data are timed relative to each other in response to the strobe signal on the strobe line 16.

Figure 7:
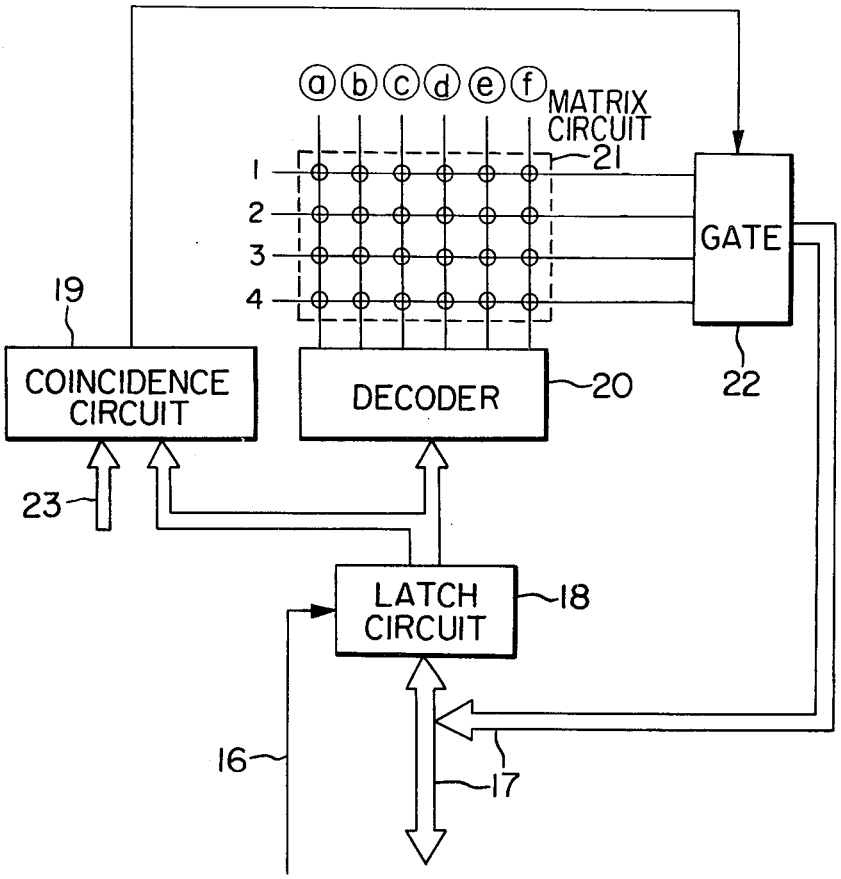
FIG. 7 is a circuit diagram of a keyboard and a timbre or tone quality selection means shown in FIG. 6.

The keyboards 1*a* through 1*c* and the timbre or tone quality selection means 10 are shown in detail in FIG. 7. A latch circuit 18 is connected to the 6-bit data bus 17 and the strobe line 16 and its output consists of the upper two bits and the lower two bits which are delivered to a coincidence circuit 19 and a decoder 20. A selection data 23 is applied to the coincidence circuit 19. The output of the decoder 20 is connected to the input of a matrix circuit 21 the output of which is connected to the input of a gate 22 which in turn is controlled in response to the output from the coincidence circuit 19.

It is assumed that when the strobe signal is "1" and the address data is "0", an input data is received. Then, the latch circuit 18 holds the address data when the strobe signal on the line 16 was "1" even after the strobe signal changes to "0". The lower four bits of the output from the latch circuit 18 are decoded by the decoder 20 so as to be converted into 16 scanning signals at a maximum which in turn are delivered to the matrix circuit 21. The matrix circuit 21 then combines them with 6 input signals transmitted over the data bus 17 and delivers a maximum of 96 data representing, for instance, the states of switches to the gate 22.

The upper two bits of the output from the latch circuit 18 are compared with the selection data 23 in the coincidence circuit 19. Different selection data are transmitted from the upper, lower and pedal keyboards 1*a* through 1*c* and the timbre or tone quality selection means 10. The coincidence signal is delivered to the gate 22 so that the data is transmitted over the data bus 17 from the matrix circuit 21. Thus, the microcomputer 11 can receive the switch data or the like over the data bus 17.

Figure 8:
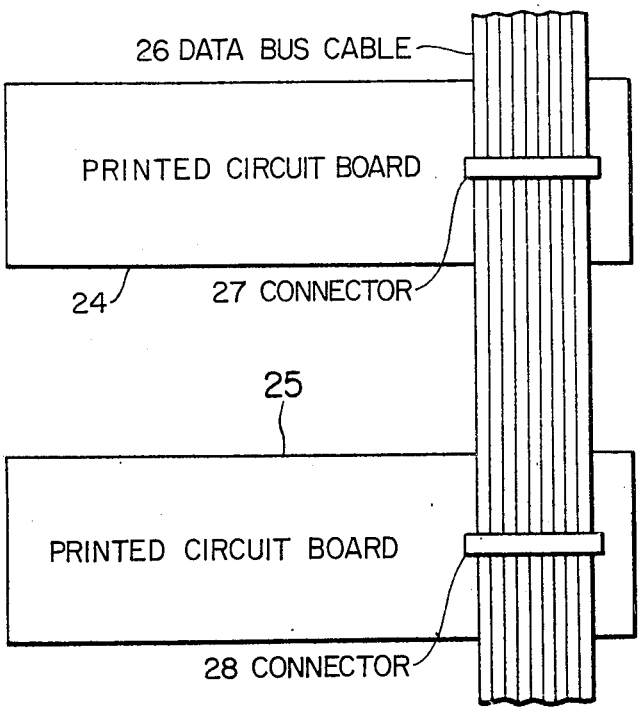
FIG. 8 shows the arrangement of elements and data bus of the embodiment shown in FIG. 6.

The circuit arrangement shown in FIG. 7 can be provided in the form of printed circuit boards as shown in FIG. 8. A printed circuit board 24 bears the circuit of the upper keyboard 1*a* while a second printed circuit board 25 bears the circuit of the lower keyboard 1*b*. Connectors 27 and 28 are connected to a data bus 26 so that the printed circuit boards 24 and 25 are interconnected to the data bus 26.

When the connectors are used to interconnect between the microcomputer 11 on the one hand and the keyboards 1*a* through 1*c* and the timbre or tone quality selection means 10 on the other hand with the data bus 26, the interconnection can be established in an extremely simple manner even when the keyboards 1*a* through 1*c* and the timbre or tone quality selection means 10 are divided into a large number of sections. In the prior art electronic musical instrument of the type described, a number of 60 signal lines is required, but according to the present invention only 9 lines; that is, six signal lines in the data bus 26, one strobe line 16 and two lines for power supply, are needed.

Figure 9:
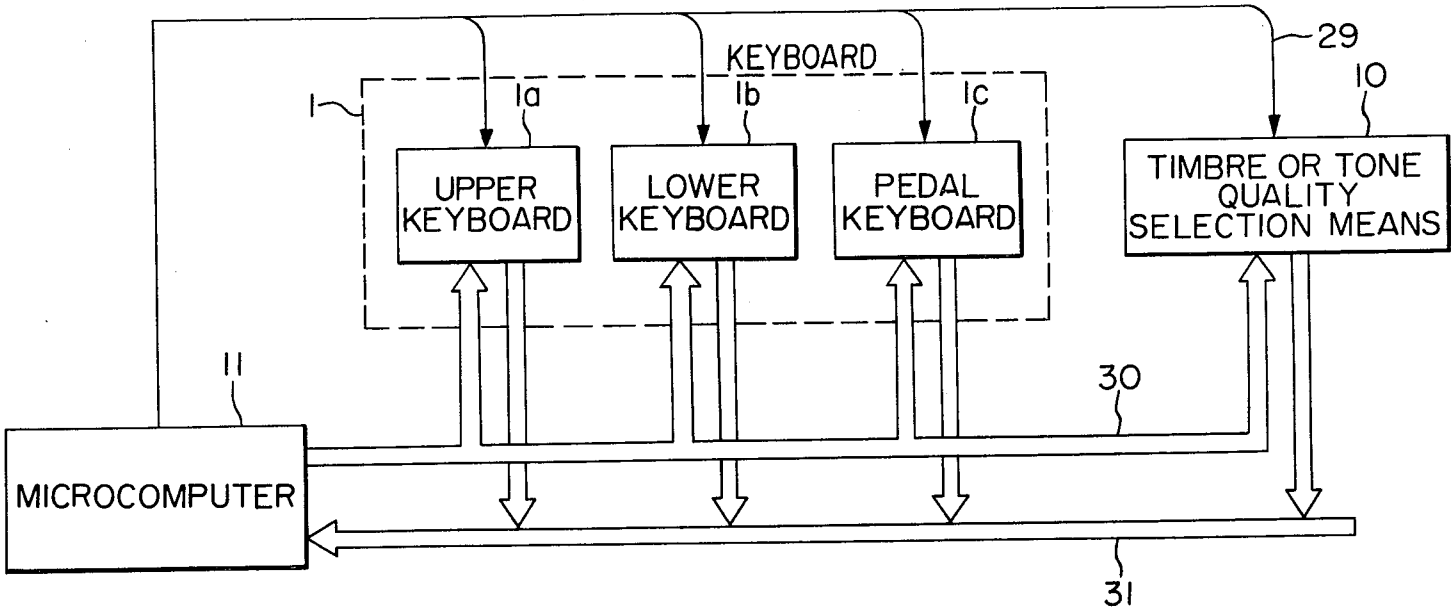
FIG. 9 is a block diagram of a further embodiment of the present invention.

Another arrangement for reducing the number of signal lines will be described with further reference to FIG. 9. In this arrangement, the lower four bits of the output from the latch circuit 18 are transmitted over an address bus 30; the matrix circuit 21 is connected to the gate 22 with an input data bus 31; and the coincidence circuit 19 is incorporated in the microcomputer 11 and connected to the upper, lower and pedal keyboards 1*a* through 1*c* and to the timbre or tone quality selection means 10 with a strobe line 29. The fundamental mode of operation is substantially similar to that of the arrangement as shown in FIG. 7. According to the arrangement shown in FIG. 9, the latch circuit 18 and the gate 22 can be incorporated in the microcomputer 11 and the coincidence circuit 19 can be replaced with a decoder. This arrangement needs only 16 signal lines; that is, four signal lines in the address bus 30, six lines in the input data bus 31, four strobe lines 29 and two lines for power supply.

In summary, according to the present invention, the keyboards and the timbre selection means can be disposed in the same space and interconnected with buses. As a result, the address data and the switch or input data can be transmitted over a few signal lines so that even when the keyboards and the assignment section are spaced apart from each other by a relatively long distance, they can be interconnected in a simplified and orderly pattern and in an extremely simple manner.

Figure 10:
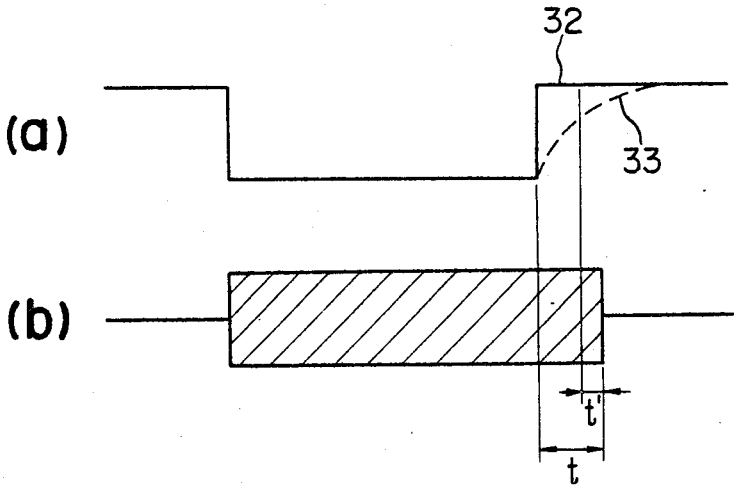
FIGS. 10(*a*) and 10(*b*) show waveforms used for the explanation why erratic operations of an electronic musical instrument occur.

In the electronic musical instrument of the type in which the microcomputer 11 is used to produce tones, the input and output data to and from the microcomputer 11 are transmitted over long lines because of the shape of the musical instrument. Meanwhile, the electronic musical instrument must process a tremendous amount of data within a short time period. Otherwise it cannot carry out its functions satisfactorily. As a result, in order to shorten the processing time, the frequency of the clock signals used in a system (data processing device) must be increased as high as possible. However, the increase in the frequency of the clock signals often results in erratic operations due to the floating capacitance on the signal lines. More specifically, when a read or write pulse as shown in FIG. 10(*a*) is transmitted on a long line, the edge as indicated by the solid lines at 32 is flattened as indicated by the broken lines at 33. It is assumed that the read-out or write-in operation be started in response to the rising edge 32 and the data be read out or written within a time interval t (see FIG. 10(*b*)). Then, when the leading edge is flattened as indicated at 33, the read-out or write-in time interval will be shortened to t'. This time interval would be further shortened due to delays in transmission through various elements and devices connected to the microcomputer 11. In the worst case, the time interval would become zero or negative. This phenomenon will become more pronounced with increase in frequency of the clock signals.

In order to prevent the erratic operations of the prior art electronic musical instruments, the clock frequency must be lowered, but the drawbacks fatal to the electronic musical instrument result because it takes a long time to process a large amount of data.

Furthermore, the upper limit on the operating frequency of the input-output device such as a RAM must be taken into consideration. Therefore, the time interval t must be sufficiently increased by lowering the clock frequency so as to avoid erratic operation of the input-output device. As a consequence, the data processing time will be increased. The upper limit of the operating frequency of each element is closely correlated with its cost. RAM with a back-up means generally consists of CMOS elements, but the upper limit on the operating frequency of the CMOS elements is not so high. In addition, when the clock frequency is increased, erratic operation will result.

As described above, in the electronic musical instrument of the type in which the data are processed in response to the clock pulses, the higher the clock frequency, the more often erratic operations result. In order to prevent erratic operations, the clock frequency may be lowered, but the data processing time will be much increased so that the electronic musical instrument cannot accomplish its functions at all.

In order to overcome such problems as described above, the clock frequency is lowered when the input data is read out or the output data is written, but is increased except the data read-out or write-in time intervals so that the overall data processing time can be shortened as will be described in detail below.

Figure 11B:
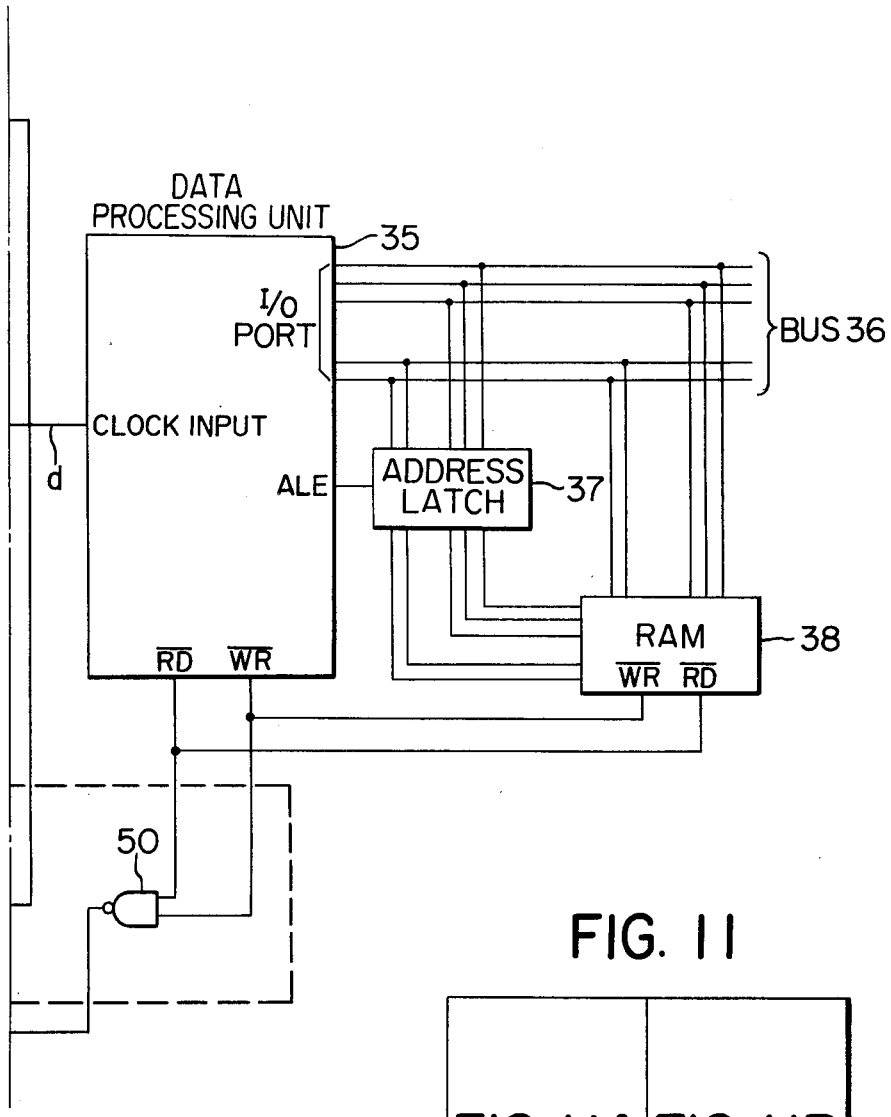
FIGS. 11, 11A and 11B constitute a block diagram of yet another embodiment of the present invention, of the type in which the clock frequency of a data processing unit is switched between a higher and a lower clock frequency.
Figure 11:
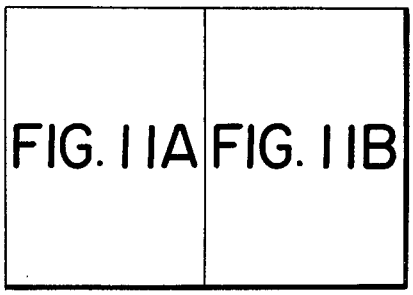
Figure 11A:
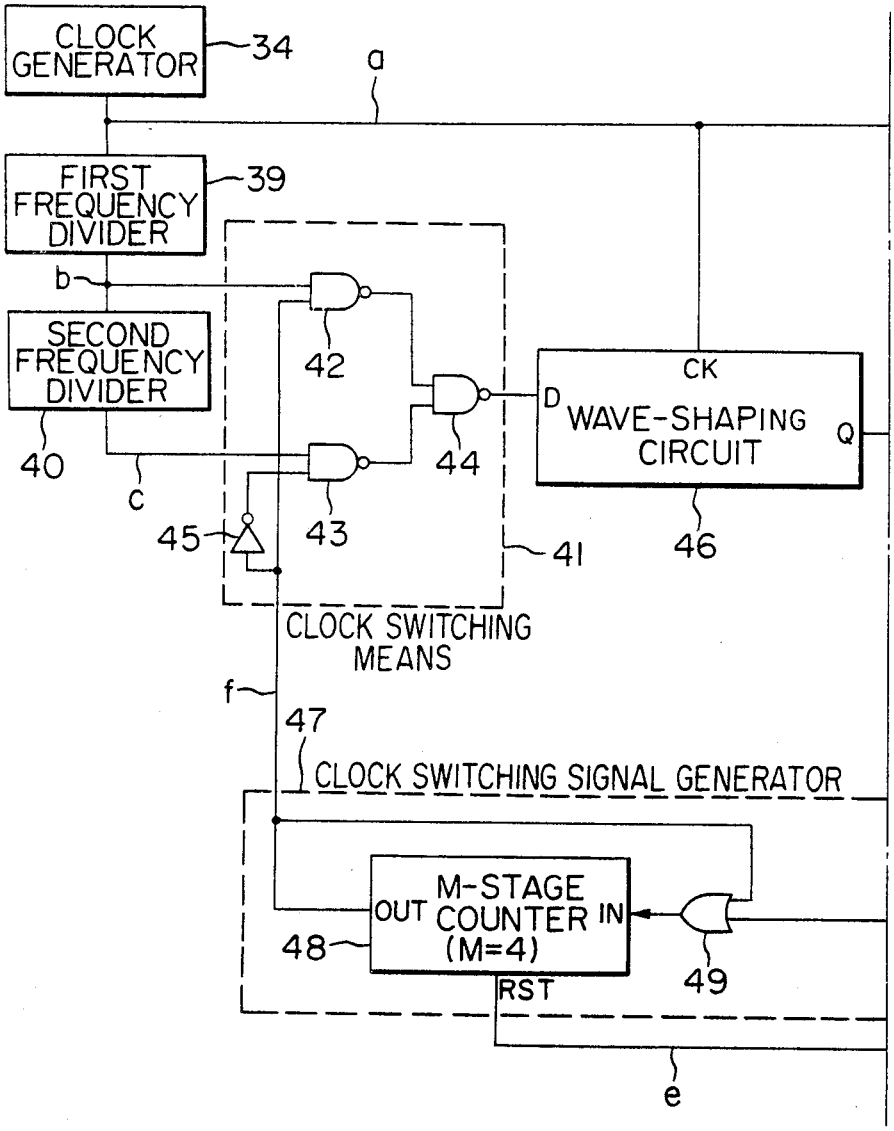
Figure 12B:
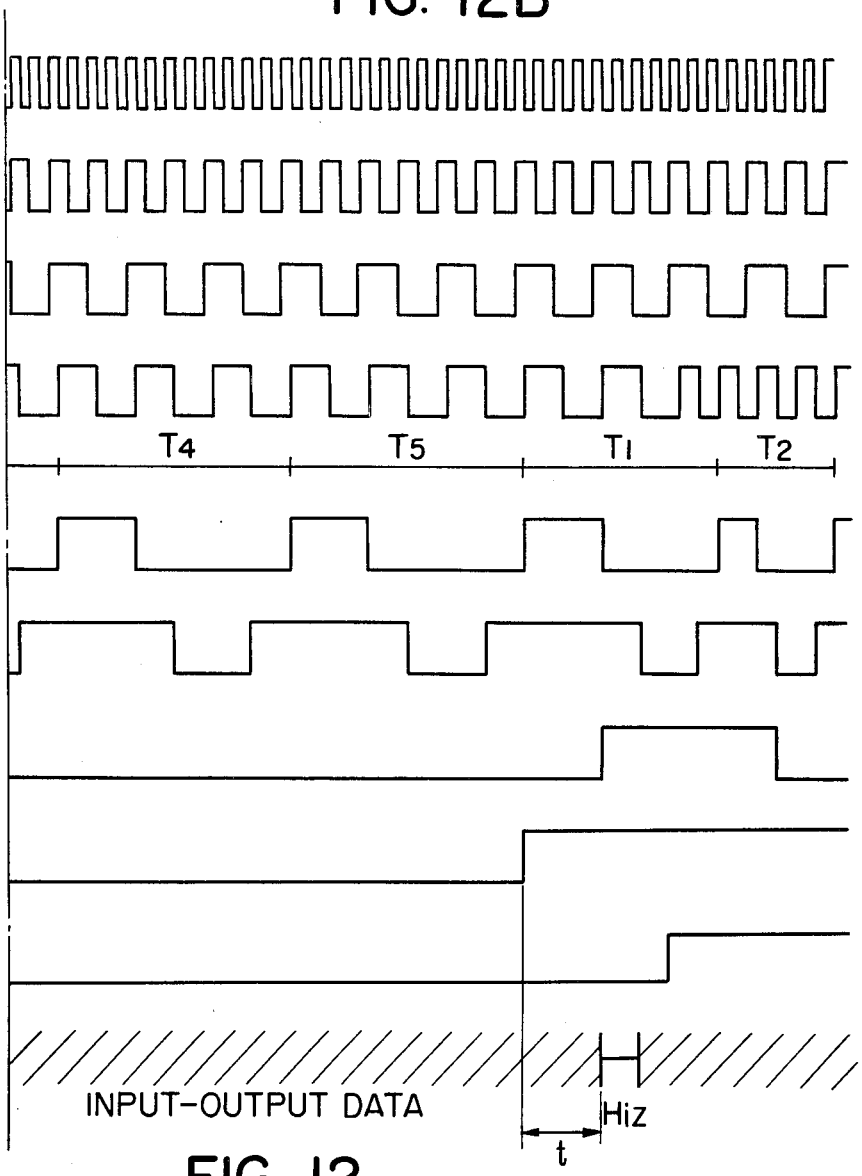
FIGS. 12, 12A and 12B show waveforms of various signals used for the explanation of the mode of operation of the embodiment shown in FIG. 11.
Figure 12:
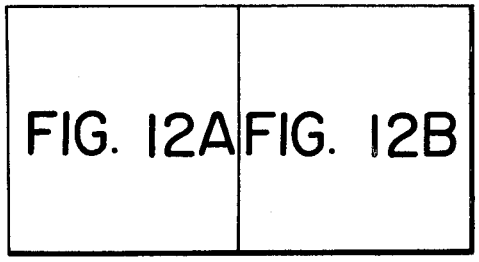
Figure 12A:
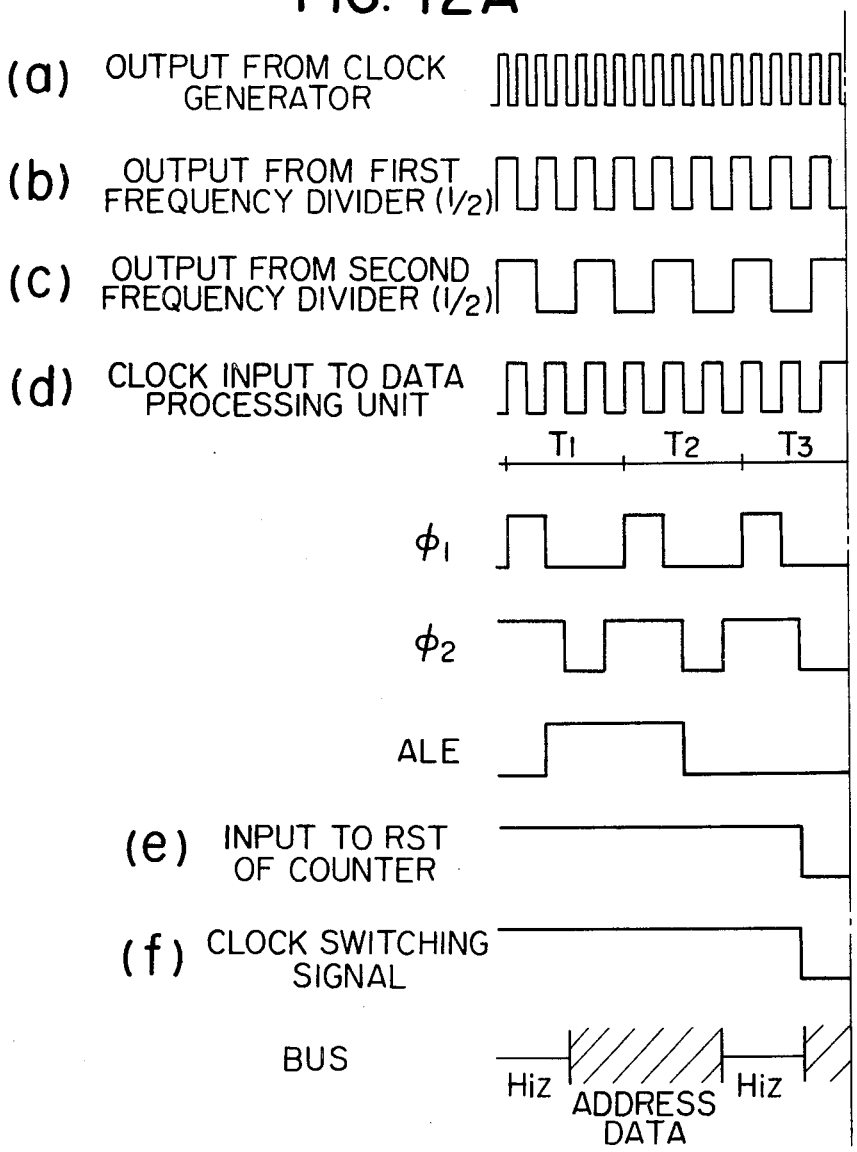

In FIGS. 11, 11A and 11B are shown in block diagram an electronic musical instrument incorporating a clock frequency switching means in accordance with the present invention. The circuit arrangement shown in FIG. 11 will be described in detail below with reference to FIGS. 12, 12A and 12B showing the waveforms of various signals at the points indicated by the reference letters a through f in FIG. 11.

The clock signal a generated by a clock generator 34 is applied to a first frequency divider 39 which in turn delivers the output b whose frequency is 1/L of that of the clock signal a. The output b is applied to a second frequency divider 40 which in turn delivers the output c whose frequency is 1/N of that of the output b. (In this embodiment, both L and N are equal to 2.) A clock switching means 41 receives the output b from the first frequency divider 39 and the output c from the second frequency divider 40 and delivers either of the output b or c to a wave-shaping circuit 46 in response to the clock switching signal f derived from a clock switching signal generator 47.

The clock frequency switching means 41 includes a NAND gate 42 which receives the clock frequency switching signal f and the output b from the first frequency divider 39. Therefore, when the clock switching signal f rises high or is at a high level, the output b is inverted, but when the signal f drops low or is at a low level, the output of the NAND gate 42 remains at a high level. The clock switching means 41 includes a further NAND gate 43 which receives the output c from the second frequency divider 40 and the clock switching signal f through an inverter 45. Therefore, when the clock switching signal f is at a low level, the NAND gate 43 delivers the output which is the inverted output c. On the other hand, when the clock switching signal f is at a high level, the output of the NAND gate 43 remains at a high level. The outputs from the first and second NAND gates 42 and 43 are applied to the input terminals of a NAND gate 44. Therefore, when the clock switching signal f is at a high level, the NAND gate 44 delivers the output b of the first frequency divider 39, but when the clock switching signal f is at a low level, it delivers the output c of the second frequency divider 40.

The wave-shaping circuit 46 (which consists of a D flip-flop) is provided in order to eliminate switching noise which appears in the output from the clock switching means 41 due to the difference in transmission lag in the NAND gates 42 and 43. The output from the clock switching means 41 is applied to a D input terminal of the D flip-flop while the output a from the clock generator 34 is applied to a CK terminal thereof so that switching noise is eliminated from the output from the wave-shaping circuit 46. The output d of the wave-shaping circuit 46 is delivered from an output terminal Q to a data processing unit 35 as a clock signal.

The clock switching signal generator 47 comprises a M-stage counter 48, an OR gate 49 and a NAND gate 50 for generating a reset signal. When OVS/RD/ (or OVS/WR/ ) of the data processing unit 35 drops low, the output e of the NAND gate 50 rises high and is delivered to the reset terminal RST of the counter 48 so that the output or the clock switching signal f of the clock switching signal generator 47 drops low. When OVS/RD/ (or OVS/WR/ ) rises high, the output e of the NAND gate 50 rises high so that the counter 48 is set. The counter 48 receives the output a from the clock generator 34 through the OR gate 49 and counts it. When the counter 48 has counted $2^{(M-1)}$ signals a, the output of the counter 48 rises high and is delivered to the input of the OR gate 49 so that the output of the OR gate 49 rises high. As a result, the output a from the clock generator 34 is prohibited from being delivered to the counter 48 so that the contents in the counter 48 remains unchanged and consequently the output thereof remains at a high level. As described above, when the OVS/RD/ (or OVS/WR/ ) signal drops low, the output f from the clock switching signal generator 47 immediately drops low, but the output f remains at a low level for a short time interval even after the OVS/RD/ (or OVS/WR/ ) has risen high. This short time interval is dependent upon the frequency of the input signal a to the OR gate 49 and the number of stages M of the counter 48. The clock switching signal f rises high immediately after the counter 48 has received or counted a predetermined number of the clock pulses a.

Therefore, the data processing unit 35 operates at a lower frequency during the read-out or write-in time interval and during a short time interval succeeding the read-out or write-in time interval so that erratic operations can be avoided. Except these continuous time intervals, the data processing unit 35 operates at a higher clock frequency so that the data processing time can be shortened.

So far the first and second frequency dividers 39 and 40 have been described as delivering the output whose frequency is one half of that of the input (that is, L and M are equal to 2) and the counter 48 has been described as having four stage (that is, M=4), but it is to be understood that L, N and M may be selected suitably as needs demand.

In summary, according to the present invention, the clock frequency is lowered when the data are read out or written, but is increased except the data read-out or write-in time interval. As a result, erratic operations due to the floating capacitance on the transmission lines can be positively avoided. In addition, the data processing time can be sufficiently shortened. Thus, the electronic musical instrument of the present invention can satisfactorily accomplish its functions.

What is claimed is:

1. An electronic musical instrument comprising:

(a) a keyboard device on which a player plays melodies or accompaniments;

(b) a sound pitch data processing means which delivers first sound pitch data specified by the actuation of each melody key of said keyboard device and simultaneously delivers second sound pitch data defining sound having a pitch above the first sound pitch data specified by actuation of each said key, each sound defined by said second sound pitch data having a frequency exceeding that of the corresponding melody note by a predetermined number of semitones so as to produce colorful sound, said sound pitch data processing means being responsive to simultaneous actuation of a plurality of said keys to simultaneously deliver said second sound pitch data for all of said plurality of keys;

(c) a sound source which receives the sound pitch data from said sound pitch data processing means so as to produce the corresponding musical sound signals; and (d) an electro-acoustic transducer means for converting the musical sound signals received from said sound source into acoustic signals.

2. An electronic musical instrument as set forth in claim 1 in which said sound pitch data processing means comprises (a) a sound pitch conversion means for converting paid first sound pitch data specified by the operation of said keyboard device into said second sound pitch data which is above said specified sound pitch data by a predetermined number of semitones, (b) a mixing means for mixing the output data from said sound pitch conversion means with said specified sound pitch data, and (c) a mixing control means for activating or deactivating said mixing means.

3. An electronic musical instrument as set forth in claim 1 in which said sound pitch data processing means has a first logic gate group and a second logic gate group, each group having the logic gates equal in number of the keys of said keyboard device, and the data of a depressed key is transmitted to said sound source through the corresponding logic gate in said second logic gate group and also transmitted to said sound source through a logic gate in said first logic gate group and a logic gate in said second logic gate group which are spaced apart from said corresponding logic gate in said second logic gate group by a predetermined number of semitones.

4. An electronic musical instrument as set forth in claim 3 in which whether or not said output data from said sound pitch conversion means and the specified sound pitch data are mixed by controlling the on-off operation of said first logic gate group.

5. An electronic musical instrument as set forth in claim 1 in which said sound pitch data processing means comprises a first key code conversion means for converting the specified sound pitch data into a first key code, a second key code conversion means for converting said first key code into a second key code which is spaced apart from said first key code by a predetermined number of semitones, and an output means for combining said first and second key codes and delivering them as an output.

6. An electronic musical instrument as set forth in claim 5 in which said first and second key codes comprise a binary code.

7. An electronic musical instrument as set forth in claim 6 in which said second key code is obtained by adding to said first key code a number corresponding to said predetermined number of semitones.

8. An electronic musical instrument as set forth in claim 6 in which said first key code comprises a first note code representative of the note of the key which is depressed and a first octave code representative of the octave which includes said note, and said second key code comprises a second note code representative of the note which is above said note of the key which is depressed by a predetermined number of semitones and a second octave code representative of the octave which includes said note above said note of the key by a predetermined number of semitones.

9. An electronic musical instrument as set forth in claim 8 in which said first and second note codes are of the duodecimal system, said second note code is obtained by the duodecimal addition to said first note code of a predetermined number corresponding to said predetermined number of semitones, and said second octave code is obtained by using said first octave code when no carry results from said duodecimal addition and by increasing said first octave code by one when said duodecimal addition results in carry.

* * * * *